US007195195B1

(12) United States Patent
Pullen, Jr.

(10) Patent No.: US 7,195,195 B1
(45) Date of Patent: Mar. 27, 2007

(54) TISSUE HOLDER

(76) Inventor: Charles E. Pullen, Jr., 116 Jackson St., P.O. Box 26, Boston, GA (US) 31626

( * ) Notice: Subject to any disclaimer, the term of this patent is extended or adjusted under 35 U.S.C. 154(b) by 0 days.

(21) Appl. No.: 11/162,712

(22) Filed: Sep. 20, 2005

(51) Int. Cl.
*B65H 75/18* (2006.01)

(52) U.S. Cl. ..... 242/598.3

(58) Field of Classification Search ..... 242/590, 242/598, 598.3, 599.3
See application file for complete search history.

(56) References Cited

U.S. PATENT DOCUMENTS

| | | | | | |
|---|---|---|---|---|---|
| 297,045 | A * | 4/1884 | Wheeler | 242/598.3 |
| 438,567 | A * | 10/1890 | Wheeler | 242/598.3 |
| 1,464,349 | A | 8/1923 | Burg et al. | |
| 2,211,576 | A * | 8/1940 | Moore | 242/599.3 |
| 2,614,762 | A * | 10/1952 | Moore | 242/598.3 |
| 3,833,180 | A | 9/1974 | Balasic | |
| 4,071,201 | A * | 1/1978 | Austin, Jr. | 242/598.3 |
| 4,099,681 | A * | 7/1978 | House | 242/598.3 |
| 4,483,491 | A | 11/1984 | Rainey | |
| 4,913,365 | A | 4/1990 | Shamass | |
| 5,398,824 | A | 3/1995 | Wolff et al. | 211/87 |
| 6,345,794 | B1 | 2/2002 | Varner | 248/309.2 |
| 6,345,797 | B1 * | 2/2002 | Ming-Hsiao | 242/598.3 |
| 6,460,799 | B1 | 10/2002 | Ryan | 242/594.5 |
| 6,554,222 | B1 | 4/2003 | Lindow, Sr. | 242/598.5 |
| 6,631,869 | B1 | 10/2003 | Kang | 242/598.5 |

* cited by examiner

*Primary Examiner*—William A. Rivera
(74) *Attorney, Agent, or Firm*—Brian D. Bellamy

(57) ABSTRACT

A tissue holder can be anchored to a wall or vertical surface by a block or anchoring device. A holding rod is adapted to be secured to the wall by the anchoring device. The anchoring device includes grooves on the rear side to clamp a first vertically oriented portion of the holding rod to the wall. A second portion of the holding rod curves from the first portion and extends outwardly from the wall, and a third portion of the holding rod curves from the second portion and extends upwardly. A tubular structure for insertion into a tissue roll has a pair of apertures that slide over the upwardly extending rods and rests on the horizontal portion of the rods to support the tissue roll.

5 Claims, 3 Drawing Sheets

TISSUE HOLDER

FIELD OF THE INVENTION

The present invention relates to a tissue holding device and more particularly to a roller type tissue holder with improved characteristics.

BACKGROUND OF THE INVENTION

Prior art tissue holders take various forms. However, such prior tissue holders are typically trouble-prone and unreliable in use. Also, some prior tissue holders are functionally complicated and inefficient. Thus improvement is desirable.

SUMMARY OF THE INVENTION

An object of the present invention is to provide a tissue holding device comprising an anchoring device; two holding arm rods including a first portion securable to a vertical surface by the anchoring device by clamping or affixing to the anchor, a second portion connected by a curve to the first portion and extending outwardly relative to the vertical surface, and a third portion connected by a curve to the second portion and extending upwardly therefrom terminating in a receiving end; and a tubular structure with two apertures formed equidistantly near opposing ends adapted to slide onto and engage the receiving ends of the holding rods.

Another object of the invention is efficiency. In operation, the tubular structure, or rolling insert, stands freely on the rods and is removed by sliding upward off of the receiving ends of the rods. Once removed, any existing paper roll is removed by sliding the tubular structure out of the roll, and a new roll is inserted onto the tubular structure by sliding the tubular structure into the roll. After placement of a roll thereon, the apertures of the tubular structure are aligned with the upwardly oriented holding member rods, and the tubular structure easily slides back onto the rods. The tubular structure slips downward and rests on the portion of the holding rods extending horizontally from the vertical surface.

Another object of the invention is to provide a tissue paper holder that does not have mechanical parts prone to failure or poor quality. The present invention may be constructed of three simple parts that are all very sturdy and inexpensive to construct of high quality material.

The above and other objects, features and advantages of the present invention will become apparent from the following detailed description and accompanying drawings.

DETAILED DESCRIPTION OF THE INVENTION

Figure 1:
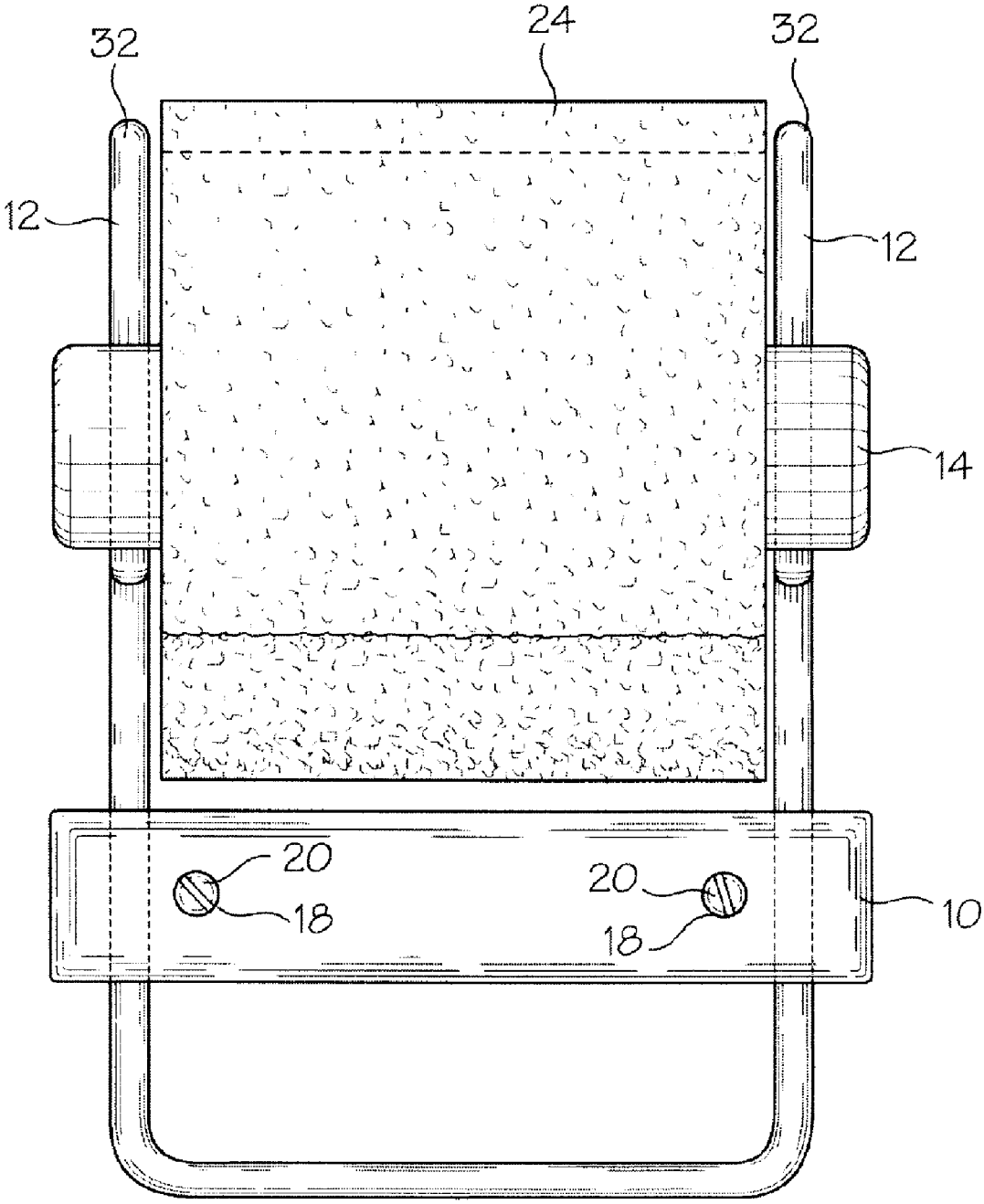
FIG. 1 is a front plan view of a preferred embodiment of a tissue holder constructed according to the invention.
Figure 2:
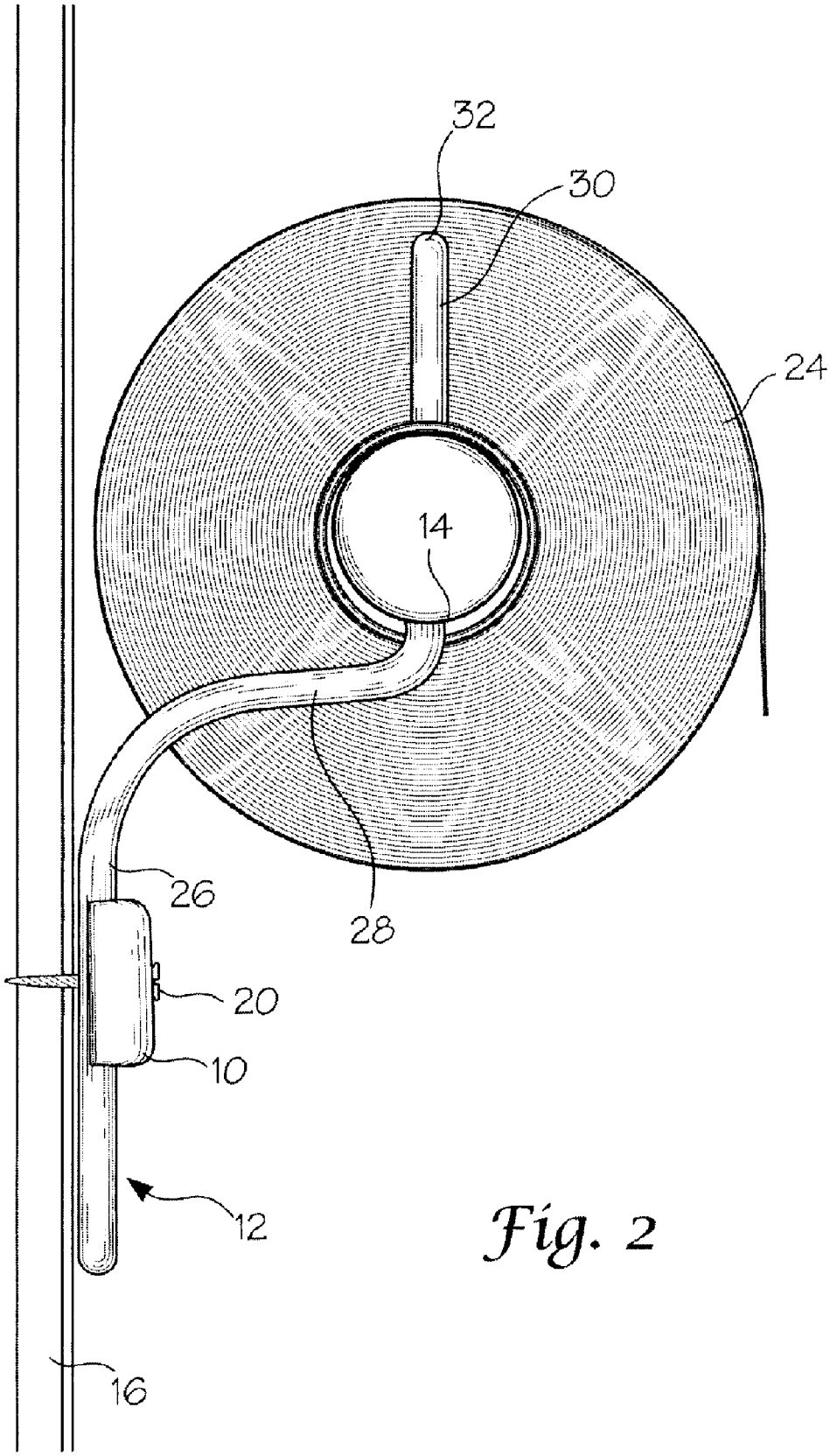
FIG. 2 is a side plan view of the tissue holder.
Figure 3:
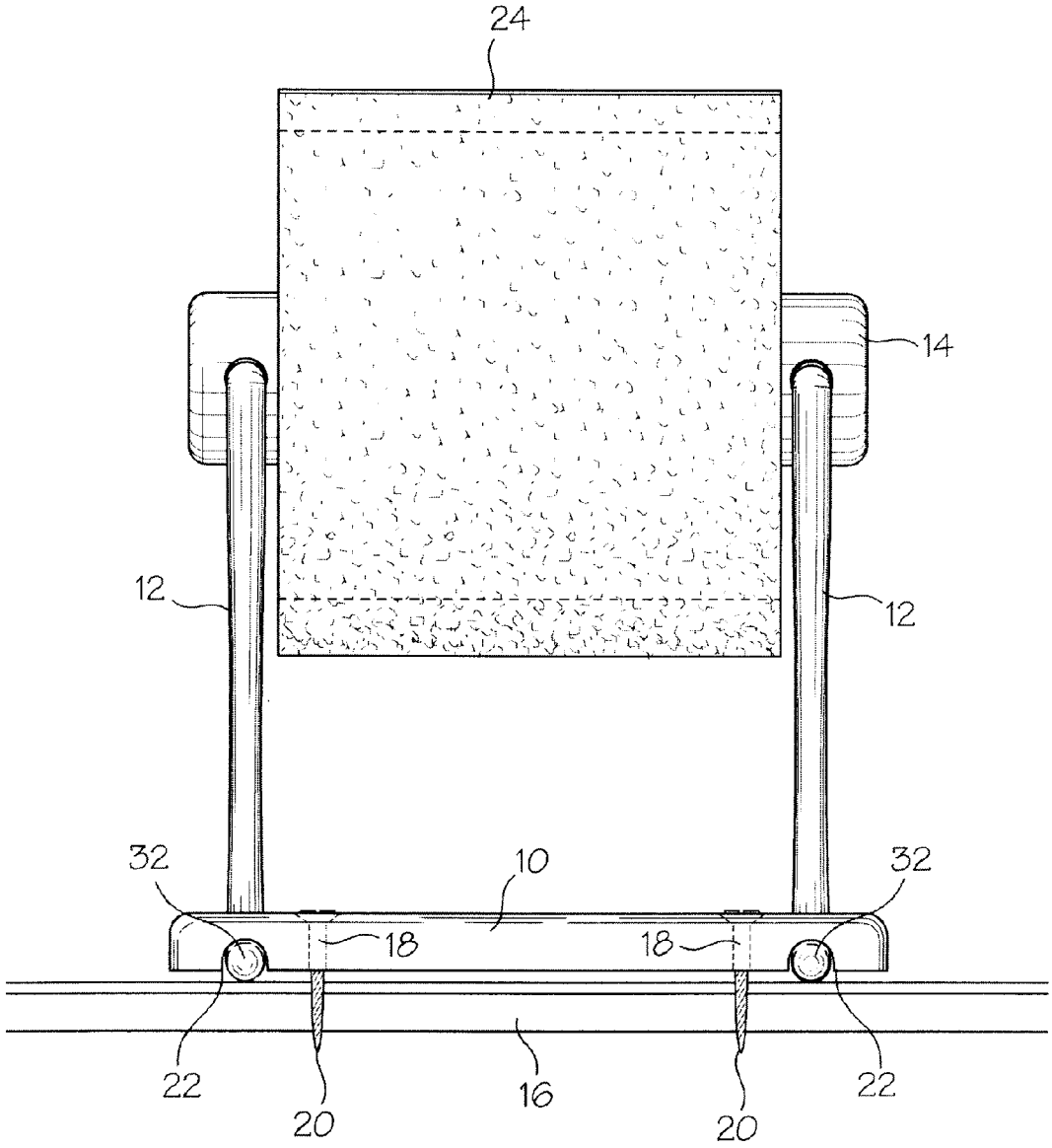
FIG. 3 is a top plan view of the tissue holder.

Referring to FIGS. 1, 2 and 3, there is shown a tissue or roll holder constructed in accordance with the invention comprising an anchoring device 10, a pair of holding arms 12, and a tubular insert structure 14.

The anchoring device 10 is constructed of hard material such as wood or metal and adapted to mount on a vertical surface 16 or wall and retain the pair of holding arms 12. The anchoring device 10 depicted in the embodiment shown comprises an attractive rectangular wood block member including two apertures 18 for insertion of mounting screws 20 and two grooves 22 on the rear of the block for retaining the holding arms 12. The holding members 12 are inserted into the elongate grooves 22 and held by clamping action upon tightening the block against a vertical surface 16. Loosening the block 10 and arranging the level of the holding members within the grooves 22 as desired may easily adjust the holding members 12. Several alternative embodiments of the anchoring device 10 will be obvious to those skilled in the art and fall within the scope of the claims hereinafter. For instance, the anchoring device 10 may be constructed of metal and attached by bolts to a hard surface such as a bathroom stall wall-member. Rather than grooves 22, the retaining member may be outfitted with brackets for insertion and retention of the holding arms 12, or the holding arms may be affixed by welding or other method as opposed to clamping. Another potential embodiment may include attachment of the anchoring device 10 to a surface by adhesive and retention of the holding arms 12 by set screws.

The holding members 12 are constructed of hard material, preferably a tubular metal or plastic to form a pair of continuous rods, and are adapted to be retained by the anchoring device 10 with respect to a vertical surface 16 and extend therefrom where they are adapted to retain the tubular structure 14 for holding a roll 24 of paper material. The pair of holding members 12 in the embodiment shown in the figures comprises first and second rods forming a parallel pair of arms extending from the anchoring device 10. Each rod is constructed identically in the particular embodiment. The construction of the rods should provide operative uniformity for retention of the tubular structure 14. The holding members 12 each comprise a first elongate section 26 for mounting against the wall surface 16, a second elongate section 28 extending outwardly from the wall surface and anchoring device 10, and a third elongate section 30 extending upwardly for reception of the tubular structure 14. Thus, as embodied in the illustration, a first vertically extending portion 26 of the rods 12 rests within the grooves 22 of the block 10 whereby the holding members are attached to the external surface 16. The first vertically extending portion of each rod extends upwardly toward a curve in each rod, as shown in FIGS. 1–2. Each rod continues from the first vertical extension 26 thereof and curves to form an outwardly extending portion 28 that traverses horizontally to extend the rods 12 away from the external surface 16, whereby the anchoring device 10 is situated below the second elongate sections 28 as shown in FIG. 2. The rod further continues from the outwardly extending portion 28 and curves again, as shown clearly in FIG. 2, to form an upwardly oriented extension 30 thereof for holding the tubular structure 14. The ends 32 of the upward extensions 30 are exposed and uniformly oriented for receiving the rolling insert structure 14.

The tubular structure 14 or insert is adapted to hold a roll 24 of paper while mating with the holding members 12. The tissue roll 24 will roll about the insert 14 to remove paper from the roll. The tubular structure 14 is generally formed as a cylinder constructed of hard, solid material as shown in FIGS. 1–3, and the tubular structure is adapted to the inside of a paper roll 24. The tubular structure 14 is elongated, and the end portions of the tubular structure extend out of the paper roll 24 and are exposed. The tubular structure 14 includes two apertures 18; each formed equidistantly near each opposing end of the tubular structure and are also exposed and outside a paper roll 24 held by the tubular structure. Each aperture 18 is adapted to slide onto and engage the awaiting ends 32 of the upward extensions 30 of the holding members 12.

During assembly and operation of the tissue holder, the tubular structure 14 is removed from the holding members 12 by sliding the tubular structure upward. Removal is very simple because the tubular structure 14 stands freely on the holding members 12. Once removed, any existing paper roll 24 is removed by sliding the tubular structure 14 out of the roll, and a new roll is inserted onto the tubular structure by sliding the tubular structure into the roll. After placement of a roll 24 thereon, the apertures 18 of the tubular structure 14 are aligned with the upwardly oriented holding member rods 30, and the tubular structure easily slides back onto the rods 12. The tubular structure 14 slides downward and rests on the section 28 of the holding members extending outwardly from the wall surface 22. Thus, the present invention provides a toilet paper or roll material holder that may be constructed of very attractive materials and that is very simple and efficient to use. Likewise, tissue paper is held very securely without mechanical parts prone to failure or poor quality.

While the invention has been described by means of specific embodiments, numerous modifications and variations could be made thereto by those skilled in the art without departing from the scope and spirit of the invention set forth in the claims.

What is claimed is:

1. A tissue roll holding device comprising:

an anchoring device;

two holding arms, each having a first portion securable to a vertical surface by the anchoring device, in which each first portion extends parallel to the other and vertically upward to a curve, a second portion connected by the curve to each first portion and extending outwardly relative to the vertical surface, a third portion connected by a curve to the second portion and extending upwardly therefrom, and the holding arms each terminating in a receiving end; and a tubular structure having opposing ends and having two apertures, each aperture being formed equidistantly near an opposing end of the tubular structure and adapted to slide onto and engage the receiving ends of the holding arms.

2. A tissue roll holding device as in claim 1 in which the anchoring device comprises a block with front and rear sides, two grooves on the rear side each adapted to receive the first portion of each of the holding arms, and means for attaching the block to the vertical surface and clamping the first portion of each of the holding arms against the vertical surface to retain the tissue roll holding device.

3. A tissue roll holding device as in claim 1 in which the holding arms each comprise a continuous elongate cylindrical rod forming the first, second and third portions of the holding arms.

4. A tissue roll holding device as in claim 1 in which the tubular structure comprises a solid cylindrical member.

5. A tissue roll holding device as in claim 1 in which the anchoring device is situated below the outwardly extending second portions.

* * * * *